United States Patent [19]

Slusarczyk et al.

[11] Patent Number: 4,691,828

[45] Date of Patent: Sep. 8, 1987

[54] CONTAINER FOR LIQUIDS

[76] Inventors: Joseph Z. Slusarczyk; Nancy L. Slusarczyk, both of R.R. 190 1, Burford, Ontario, Canada, N0E 1A0

[21] Appl. No.: 807,466

[22] Filed: Dec. 10, 1985

[51] Int. Cl.[4] ..... B65D 21/02

[52] U.S. Cl. ..... 206/509; 206/510; 215/10; 220/94 A; 446/124

[58] Field of Search ..... 206/508, 509, 510; 215/10; 220/94 A; 446/124

[56] References Cited

U.S. PATENT DOCUMENTS

| | | | |
|---|---|---|---|
| 3,374,917 | 3/1968 | Troy | 215/10 |
| 3,387,749 | 6/1968 | Govshalk | 220/94 A |
| 3,724,710 | 4/1973 | Davis | 206/508 |
| 3,940,013 | 2/1976 | Bonnett | 206/510 |
| 4,274,556 | 6/1981 | Thiessen | 220/94 A |
| 4,386,701 | 6/1983 | Galer | 215/10 |

FOREIGN PATENT DOCUMENTS

| | | | |
|---|---|---|---|
| 2274329 | 1/1976 | France | 446/124 |

*Primary Examiner*—George E. Lowrance
*Attorney, Agent, or Firm*—Ridout & Maybee

[57] ABSTRACT

A container for liquids is formed of a shell of resilient plastic which defines a hollow body with at least two spaced posts upstanding from one side, and at least two recesses on the opposite side in which the posts of similar containers may be snugly received. One post has an opening at its upper end for filling the container and emptying liquid from it. The container can be used for the packaging and sale of liquids and, after the container has been emptied of its liquid contents, the containers can be used as toy interlocking building blocks. The stacking of the containers with the posts of containers received in the recesses of adjacent containers in interlocking fashion also facilitates the building of walls or other extensive assemblies of the containers for display purposes and the like.

9 Claims, 4 Drawing Figures

CONTAINER FOR LIQUIDS

Liquids such as edible liquids, for example, milk, liquid dairy products, mineral water, fruit and vegetable juices and oils, and non-edibles, e.g. liquid bleach and detergents, are often sold in moulded plastic containers. The containers are often configured to provide a body portion and a spout or pouring portion of more or less reduced width. These containers are usually non-refillable and are treated as disposables which in most cases are discarded by the consumer or purchaser after use. The discarding of the empty containers represents an economic loss of the materials and resources used for the production of them. Moreover, known containers of the above type tend not to be stable when stacked one on another, and therefore are not conveniently stackable for display purposes.

The present invention provides a container for liquids comprising a shell of resilient plastic defining a hollow body, at least two hollow spaced posts upstanding from one side thereof, and at least two recesses on the opposite side in which the posts of similar containers may be snugly received, one post having an opening at its upper end for filling and emptying liquid from the container. The containers of the invention, after emptying of their contents, can be employed as interlocking toy building blocks, and thus have continued usefulness even after they are no longer useful for their original or primary purpose as a container of a liquid. By virtue of the provision of the two or more posts on the containers and the two or more recesses on the opposite side, a plurality of the blocks may be built up into a wall, for display purposes, for example before sale, or when the containers are used as toy building blocks. Such wall can consist of courses in which the posts of a container beneath are received in the recesses of containers above, and each container is staggered with respect to the containers in the adjacent courses, so that an interlocking structure having lateral stability is achieved.

An example of one form of container in accordance with the invention is shown in the accompanying drawings, wherein.

Figure 2:
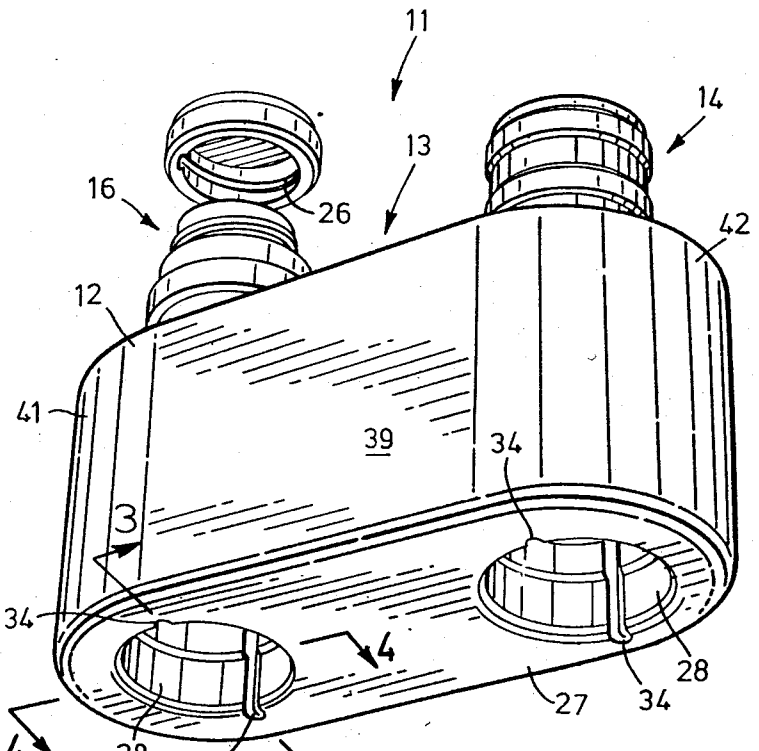
FIG. 2 is a perspective view from beneath.

Referring to the drawings, a container for liquids 11 comprises a hollow shell 12 having a thin wall defining a hollow generally rectangular body 13. On the upper side of the body 13, the shell 12 defines two hollow cylindrical posts, 14 and 16.

Figure 4:
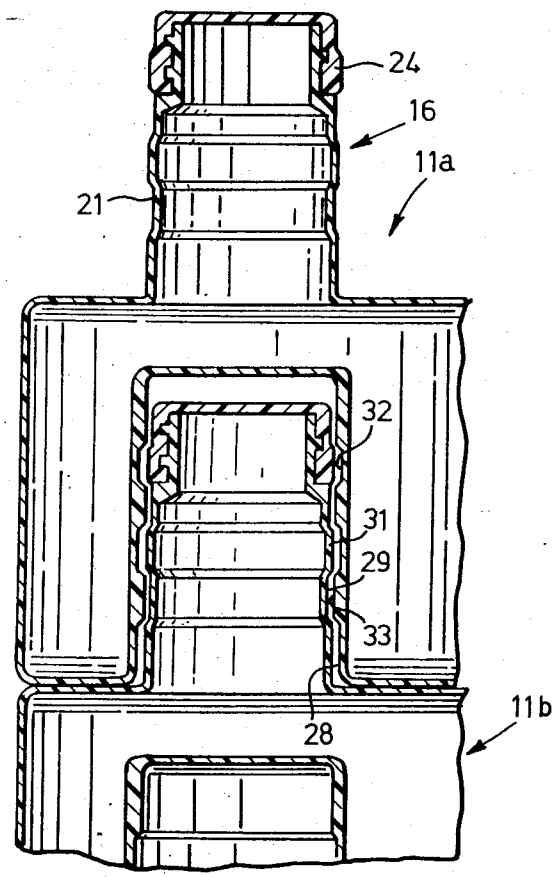
FIG. 4 is a sectional view taken on the line 4—4 in FIG. 2, wherein one container is stacked on another.
Figure 3:
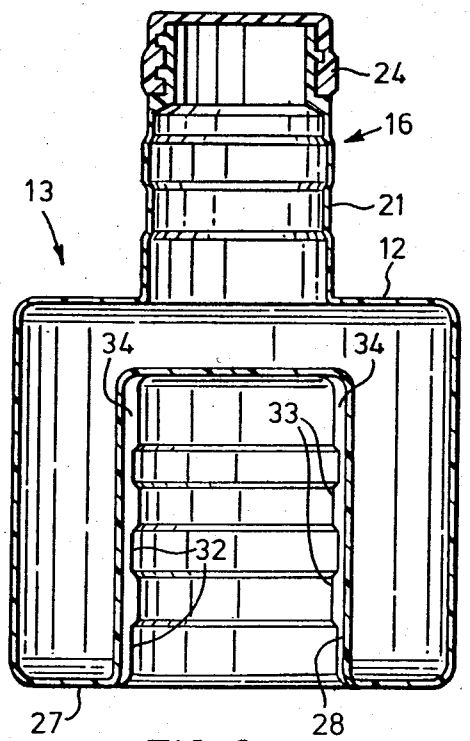
FIG. 3 is a sectional view taken on the line 3—3 in FIG. 2.

Post 14 has a generally cylindrical side wall 17 integrally connected at its upper end with a circular transverse end face 18. The lower end of the side wall 17 is integrally connected to an upper side 19 of the shell forming a generally planar upper surface of the body 13. The other post 16 is likewise formed of a generally cylindrical side wall 21, but terminates at a circular upper opening 22 which forms a pour opening through which liquid can be introduced into the container 11 or through which liquid can be dispensed. The opper end of the side wall 21 is formed with a screw thread 23, and a cap member 24 is provided, and is formed integrally with a screw thread groove 26, so that the cap 24 can be threaded securely onto the upper surface of the side wall 21, as shown in FIGS. 3 and 4, thus closing or sealing the container 11.

On the side of the body 13 opposite the side 19, the shell 12 defines a lower, generally planar side 27 on which the container can stably support itself on a planar surface. In the side 27 there is formed a pair of recesses 28. The recesses 28 may be of the same spacing as the posts 14 and 16, and their length is larger than the length of the posts 14 and 16 and their diameter slightly larger, so that they snugly receive the posts of similar containers when two of the containers 11*a* and 11*b* are stacked one on the other, as shown in FIG. 4. As will be seen for example from FIGS. 3 and 4, the length of the posts 14 and 16 and the recesses 28 is substantially greater than half the distace between the upper and lower sides 19 and 27.

In use, the container 11 may be employed as a packaging for sale of an edible or inedible liquid, the liquid being introduced through the opening 22, and the cap member 24 thereafter applied. Prior to applying the cap 24, the opening 22 may be sealed with a sealing disk adhered to the upper edge of the side wall 21 in a manner known in itself, so that the container is sealed by the sealing disk rather than by the cap member 24. This permits a secure sealing of the container even where the cap member 24 is not a tight sealing fit on the side wall 21 of the post 16, and has the additional advantage of providing a security seal and rendering the container tamper-evident. One advantage of the present container as a container for retail sale and the like is that a number of the containers can be readily stacked for display purposes in the form of a wall or the like formed of a plurality of horizontal courses, as described in more detail below.

After emptying of the container by the purchaser, the containers, having the cap member 24 reapplied, have considerable utility as toy building blocks. By virtue of the containers having at least two upstanding posts and at least two corresponding recesses, it is possible to arrange the containers, whether for display purposes when full or when playing with the containers, in horizontal courses or tiers in which each container is staggered with respect to the containers in the adjacent courses or tiers, so that the assembly of containers is interlocked since each container is connected to the horizontally adjacent container through the container or containers immediately vertically adjacent, and thus considerable stability is conferred on the assembly.

In the preferred form, when the cap member 24 is applied on the post 16 having the pour opening 22, the exterior profile of the post 16 is the same as that of the post 14, so that the pour opening 22 is closed in the condition in which the container is useable as a toy. However, it will be appreciated that it would be possible to employ other arrangements in which, when the cap member 24 or other closure member of the container is removed, the post 16 is of exterior configuration and profile identical to the post 14, except for its opening 22, and can thus be received interchangeably in similar recesses. In other arrangements, both posts 14 and 16 are identical, i.e. both are formed with openings 22 and screw caps 24.

Desirably, in order to provide the post and recess with adequate frictional resistance to disengagement, the exterior of each post, together with the cap 24, is formed with a series of alternating circumferentially-extending grooves 29 and ribs 31, and each recess 28 is formed with similar complementary grooves 32 and ribs 33, which are dimensioned so that the internal dimensions of the ribs 33 in the recesses 28 are approximately the same as the external diameter of the ribs 31 on the posts 14 and 16, so that the ribbed surfaces on the posts 14 and 16 tend to ledge within the ribbed surfaces of the recesses 28.

In the preferred form, a pair of vent channels 34 are formed in opposite sides of the side walls of the recesses 28 and extend axially upward toward the upper end of each recess 28, as seen in FIG. 3, so that when a post is inserted or withdrawn, air is not trapped and suction is not created within the recess, and thus assembly or disassembly of the container is not undesirably hindered.

Advantageously, the container is formed in its upper wall with a cavity 36 in which is integrally moulded a carrying handle in the form of a crossbar 37, the ends of which are joined integrally with portions of the shell 12 forming opposing sides of the cavity 36.

It is an advantage of the present arrangement that it is not necessary for the container to be moulded with fine dimensional tolerances in order to be useable as a toy interlocking building block. The container can be readily moulded of resilient plastics, for example polyethylene or polypropylene, using known moulding techniques, for example blow-moulding or rotational moulding.

Desirably, in order to permit the toy to be used for construction of walls and the like which are relatively laterally extensive in relation to their depth, the container is elongated, and the posts 14 and 16 and recesses 28 are spaced apart in the longitudinal direction of the body, as shown.

Preferably, opposing lateral walls 38 and 39 of the body are generally planar and continuously smooth, and the ends 41 and 42 are continuously smooth, without any posts or other projections or recesses thereon.

Preferably, the posts 14 and 16 and the recesses 28 are each disposed symmetrically with respect to a median plane bisecting the body 13 between the posts 14 and 16. As will be appreciated, in order to build walls with the containers in staggered relationship, the spacing x of each post from the adjacent end of the body 13 and the spacing y of each recess from one adjacent end should be such that $2(x+y)$ is less than or equal to L, where L is the length of the body. X and y need not be, but preferably are, the same, i.e. the recesses 28 are spaced apart at the same distance as the posts 14 and 16, so that containers can be stacked one on another in non-staggered relation, if desired. Desirably, the posts and the recesses 28 are spaced apart on the body 13 such that when a number of the containers are assembled in a wall with the containers in adjacent courses staggered relative to one another, the ends of the horizontally adjacent containers approximately meet, i.e. $L=2(x+y)$, so that a continuous wall is achieved. For example, the posts and recesses may be spaced inwardly from the ends of the container by a distance approximately one-quarter the length of the container, i.e. $x=y=L/4$.

Figure 1:
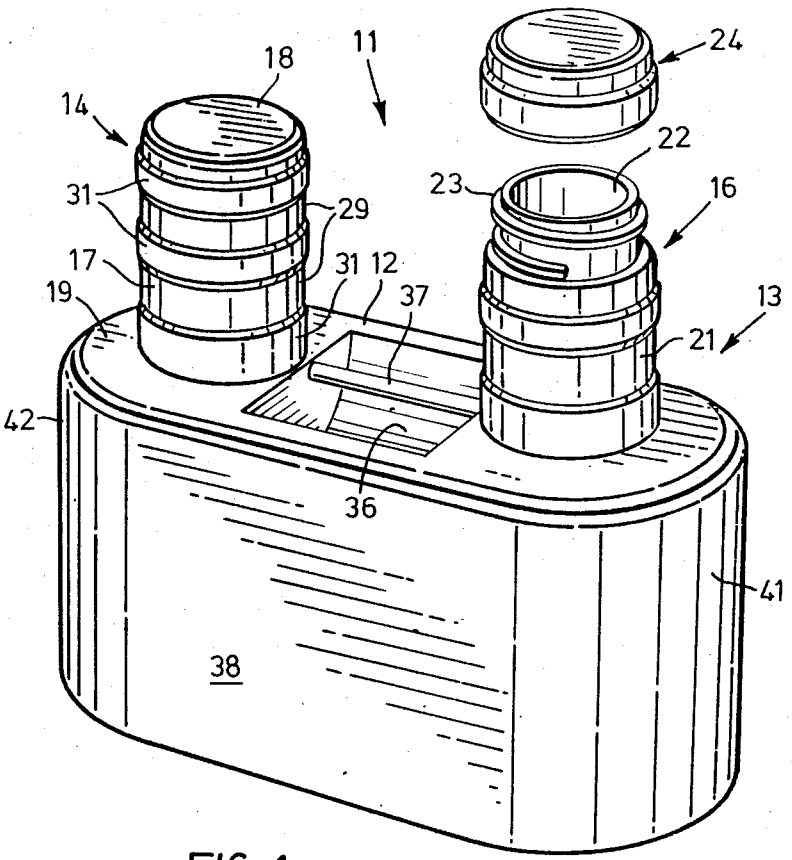
FIG. 1 is a perspective view of a container in accordance with the invention.

In order to permit laterally adjacent containers to be swivelled relative to one another, in order to form a wall generally curved in plan, for example in the form of a cylindrical wall, without the ends of the adjacent containers interfering with one another, the ends 41 and 42 of the containers are desirably convexly rounded, e.g. are plano convex as shown in FIGS. 1 and 2, with each post 14 and 16 disposed at approximately the centre of curvature of the rounded end 42 and 41, respectively, adjacent thereto.

As will be appreciated, various modifications and variations are possible. For example, versions having three or more posts or recesses may be employed. Advantageously, a set of containers for liquids may be provided which may include, apart from a container having two posts and two recesses as illustrated: a relatively elongated container having four posts and four recesses at the same spacings as the container having the two posts and recesses, for use as as auxiliary building block for constructing window frames, lintels, and the like; a container of body length half that of the two post container, and having a single post and single recess, which may be employed for filling in gaps resulting from the above-described staggered form of construction at vertical edges of walls and the like formed from the containers; and containers having recesses in their lower side, but having a planar upper side, without posts, which may be used for capping the upper surfaces of constructed walls and the like to provide a smooth and regular profile.

We claim:

1. A container for liquids comprising a shell of resilient plastic defining an elongated generally rectangular hollow body having a longitudinal axis, two longitudinally spaced hollow posts upstanding from an upper generally planer side thereof, each post being closely adjacent a respective end of said elongated hollow body, a generally planar lower side on which the container can stably support itself on a planar surface having therein two recesses aligned with said posts in which the posts of similar containers may be snugly received, one post having an opening at its upper end for filling the container and emptying liquid from it, the ends of the body being convexly rounded and the lateral walls and ends of the body being continuously smooth, and wherein the body is provided with a cavity extending downwardly in said upper side between the posts in which an elongated handle grip is formed, the handle grip being disposed below the general plane of said upper side and extending between the posts along said longitudinal axis.

2. A container as claimed in claim 1 wherein the post having an opening at its upper end has a closure cap, and the post together with its closure cap secured thereto is of the same exterior configuration as the or each other post.

3. A container as claimed in claim 2 wherein the closure cap is threaded on the post.

4. A container as claimed in claim 1 wherein each post is formed with a circumferentially-extending rib and a circumferentially extending groove, and the interior of each recess is formed with a corresponding rib and groove for at least loosely engaging the rib and groove on a post when received therein.

5. A container as claimed in claim 1 wherein the side wall of each recess is formed with an axially extending channel through which air can be vented on insertion and withdrawal of the post therefrom.

6. A container as claimed in claim 1 wherein each post is disposed at approximately the centre of curvature of the rounded end adjacent thereto.

7. A container as claimed in claim 1 wherein the posts are spaced apart the same distance as the recesses.

8. A container as claimed in claim 7 wherein the posts and recesses are each spaced inwardly from the adjacent end of the body a distance approximately one quarter the length of the container.

9. A container as claimed in claim 1 having said posts and recesses of greater length than half the distance between said upper and lower sides.

* * * * *